US006687636B2

(12) United States Patent
Van Sant

(10) Patent No.: US 6,687,636 B2
(45) Date of Patent: Feb. 3, 2004

(54) METHOD OF ESTIMATING SOLENOID HEAT ACCUMULATION AND COMPENSATING FOR SOLENOID FORCE LOSS

(75) Inventor: Mark A. Van Sant, Oregon House, CA (US)

(73) Assignee: Burgett, Inc., Sacramento, CA (US)

( * ) Notice: Subject to any disclaimer, the term of this patent is extended or adjusted under 35 U.S.C. 154(b) by 23 days.

(21) Appl. No.: 10/039,212

(22) Filed: Jan. 4, 2002

(65) Prior Publication Data

US 2003/0191597 A1 Oct. 9, 2003

Related U.S. Application Data

(60) Provisional application No. 60/282,696, filed on Apr. 9, 2001.

(51) Int. Cl.[7] ..... G01K 15/00
(52) U.S. Cl. ..... 702/99
(58) Field of Search ..... 702/99, 97; 84/22; 361/154; G01K 11/00

(56) References Cited

U.S. PATENT DOCUMENTS 4,169,401 A 10/1979 Walker
4,872,124 A * 10/1989 Shimizu et al. ..... 702/97
5,831,809 A 11/1998 Schmitz et al.
6,153,819 A 11/2000 Yorba

FOREIGN PATENT DOCUMENTS

JP 2000-266610 * 9/2000 ..... G01K/11/00

* cited by examiner

*Primary Examiner*—John Barlow
*Assistant Examiner*—Tung Lau
(74) *Attorney, Agent, or Firm*—John P. O'Banion

(57) ABSTRACT

A method of estimating solenoid heat accumulation and providing output power compensation thereof. The method is particularly well suited for compensating the drive solenoids within a player piano mechanism, or similar. A heat value is maintained for each coil whose accumulated heat is of interest. A quantity of heat is periodically removed from each heat value which corresponds to the level of thermal dissipation for the solenoid during the period. Similarly, a quantity of heat is periodically added to the heat value to account for the power being applied to the active solenoids. A gain compensation value may then be calculated from the heat value and used to temperature compensate the power being applied to the solenoids wherein force roll-off is prevented in response to solenoid use.

26 Claims, 4 Drawing Sheets

METHOD OF ESTIMATING SOLENOID HEAT ACCUMULATION AND COMPENSATING FOR SOLENOID FORCE LOSS

CROSS-REFERENCE TO RELATED APPLICATIONS

This application claims priority from U.S. provisional application serial No. 60/282,696 filed on Apr. 9, 2001, incorporated herein by reference.

STATEMENT REGARDING FEDERALLY SPONSORED RESEARCH OR DEVELOPMENT

Not Applicable

REFERENCE TO A COMPUTER PROGRAM APPENDIX

Not Applicable

BACKGROUND OF THE INVENTION

1. Field of the Invention

The present invention pertains generally to methods for driving solenoids and more particularly to a method of estimating heat accumulation within solenoids and providing compensation thereof.

2. Description of the Background Art

A wide array of electromechanical systems utilize solenoids for converting electrical signals into a mechanical counterpart. One such system is that of an electronic player piano utilizing electrical solenoids for driving the keys of the piano. A solenoid is an electromechanical device having a conductive coil which is retained proximal to a mechanical assembly having one or more magnetic components capable of movement in response to changes in the magnetic field of the conductive coil. Solenoids can generate various forms of motion, such as radial, or linear. The use of a solenoid may be generally separated into one of two general classes.

The first class of use is "non-linear", in which the solenoid is typically retained in one of a number of fixed states, typically two. When utilized non-linearly, the purpose of the solenoid is to readily reach the fixed state, therefore the solenoid is generally driven toward one of the fixed states under a predetermined set of fixed drive conditions, or set drive voltage. For example a drive transistor is switched on to source or sink current through the coil of the solenoid so that the translation mechanism, such as a cylindrical plunger, quickly moves to an active state. The drive transistor is then typically maintained in the given active state until the translation mechanism is to be moved back toward the non-active state, wherein the transistor is switched off to stop the flow of coil current. Alternatively, solenoids may be driven by other means such as by a push-pull driver circuit, and so forth.

The second class of use may be termed "linear", wherein the solenoid is linearly driven to achieve intermediate positions or desired characteristics of motion, such as a given speed, or force, at a particular point in time. When driving a solenoid in linear mode, the electromagnetic and mechanical characteristics of the circuit, solenoid, and the coupled mechanical device must be taken into account. Solenoids driven in a "linear" manner may be utilized in a number of applications wherein the position, velocity, acceleration, or force of the solenoid output is to be linearly controlled. One application for which linear solenoid drive is preferable is within electronic player-piano mechanisms. The linear solenoid driving refers to the response of the solenoid and is not to be confused with the input signal applied to the solenoid. It will be appreciated that the output of a solenoid may be linearly controlled by the application of either analog or digital signals, for example in a similar manner that analog audio may be generated from passing analog signals through a "Class A" amplifier, or by using digital signals and a "Class D" amplifier. A number of applications require that the coil be driven in an analog manner to achieve the desired output characteristics for the system. One such application is that of player pianos utilizing electronic player mechanisms which incorporate electrical solenoids to control activation of the keys, such as the eighty eight (88) keys contained on a conventional piano keyboard, in response to composition data.

The majority of modern player pianos utilize electrical solenoids for driving the keys of the piano. The signals applied to the solenoids allow for the control of key speed and force. Changes in solenoid movement are accomplished by altering the drive voltages being applied to the coil of the solenoid. The amount of current flow through the coil is determined by the drive circuits and the resistance of the coil. Heat is generated as a by-product of the current flowing through the resistance of the coil and as a result the temperature of the solenoid can increase significantly under recurrent or extended operation. In response to increases in coil temperature, the amount of coil resistance increases and the drive characteristics of the solenoid are thereby altered. One of the negative aspects of the solenoid temperature increase is the resultant decrease in the coil drive current associated with any given drive voltage. As a result, the velocity, acceleration, and force of the solenoid mechanism diminishes as the solenoid heats up. Within player pianos the force roll-off is exhibited as an attenuation of audio volume on keys which have been played repeatedly, thus skewing the reproduction of accurate sound. FIG. 1 shows audio volume roll-off in response to coil temperature increases as a key is repeatedly activated over a period of time. It can be seen from the graph that the audio volume drops approximately thirteen decibels (13 db) over a thirteen minute test interval. It will be appreciated that a drop of six decibels (6 db) equates to an amplitude drop of approximately one half. Continued energizing of the coil at a sufficient current level results in the coil temperature reaching an equilibrium temperature in which the rate of heat dissipation equals the amount of heat generation in the coil.

It has been recognized, therefore, that accurately driving a solenoid requires taking the solenoid coil temperature into account. One proposed method of compensating for solenoid temperature changes requires the incorporation of a temperature sensor within each solenoid. It will be appreciated that the addition of eighty eight (88) temperature sensor and conditioning circuitry to a player piano can substantially increase both the cost and complexity of the player mechanism. The temperature of the solenoid is periodically measured and the electrical output of the solenoid drive circuit is adjusted accordingly to reduce sound changes in response to solenoid temperature. Furthermore, the temperatures measured by these individual temperature sensors are subject to a delay error as they are typically mounted on the exterior of the coil and themselves have a thermal mass, wherein the temperature registered by the temperature sensor can be out of phase with the temperature profile of the solenoid at its core for which the compensation is desired.

Therefore, a need exists for a method of determining solenoid temperature without adding temperature sensors to each solenoid. The present invention satisfies those needs, as well as others, and overcomes the deficiencies of previously developed solutions.

BRIEF SUMMARY OF THE INVENTION

The present invention provides a method of estimating the heat accumulated within a solenoid without the necessity of adding a temperature sensor for each solenoid. The described method eschews the cost and reliability issues inherent in adding temperature sensors and allows for compensation of solenoid drive power in response to solenoid heat accumulation.

The method described for the present invention recognizes that, given a reasonably constant ambient temperature, the temperature of the solenoid is typically a function of its recent activation history. The heat accumulated by the solenoid is estimated by registering the power absorbed by the solenoid during periods of activation, while subtracting an amount of heat proportional to the heat dissipation. It will be appreciated that heat is always being dissipated by a solenoid that has accumulated heat, and that the temperature of an inactive solenoid will move toward the ambient temperature. The temperature, however, of solenoids which are subject to sufficient levels of activation will attain a thermal equilibrium condition wherein continued activations will not continue to raise the accumulated heat of the solenoid.

The temperature of the solenoid therefore increases during activation as a function of applied current, the thermal mass, and the thermal resistance of the solenoid coil. Upon becoming inactive, the solenoid temperature drops toward the ambient temperature as a function of the extent of temperature elevation, the thermal mass, and the thermal resistance of the solenoid coil. The method of the present invention tracks the power applied to each solenoid and the cooling effects of thermal heat dissipation. In applications designed to minimize motion and force fluctuations, or applications subject to a narrow ambient temperature range, an actual value for solenoid temperature need not be maintained and there is consequently no need to measure the actual ambient temperature. The aforementioned player piano application is one such example of a system utilizing solenoids that is well suited to non-absolute value temperature estimation. In the case of a player piano, the ambient temperature surrounding the piano is held in a narrow range of temperature while it is the relative changes in solenoid force and motion that are to be reduced. It will be appreciated, however, that within systems designed to minimize changes in absolute solenoid force and motion, a single temperature sensor may be added to the present system to register ambient temperature, wherein the estimations of the elevation of temperature for each individual solenoid will take into account the actual measured ambient temperature. By way of example, absolute value applications of this nature may include systems such as those found within factory and laboratory automation systems.

In performing the estimation of temperature elevation within the solenoid, a heat value is maintained for each solenoid. The heat value may range between a lower limit that equates to the ambient temperature and an upper limit which equates to a condition of thermal equilibrium. The heat value is periodically decreased to take into account the heat being dissipated by the solenoid. In periods of relative inactivity, the temperature of the solenoid decreases toward the ambient temperature. In response to periods of solenoid activity, the heat value is periodically increased according to the amount of power being applied to the solenoid. By way of example, incrementing and decrementing the heat value may be performed on a periodic basis wherein the heat value can gradually decrease or increase in response to the changing conditions. Alternatively, the heat value can be recalculated when a change of state has occurred or is necessitated.

It should be appreciated that under certain conditions the heat value may decrease during a period of solenoid activity. For example, if the level of power applied to the solenoid is lowered after an extended period of higher power activation, the thermal dissipation level as a result of the elevated temperature of the solenoid may still exceed the applied power, wherein the temperature and corresponding heat value will be correspondingly decreasing.

Estimation methods are subject to a lack of precision and error accumulation within most applications, wherein system performance diverges over time from the desired operation. It should be appreciated, however, that the operation of a solenoid within the present invention is not subject to substantial error-accumulation because a solenoid subject to sufficient activity, or inactivity, will attain a thermal equilibrium state at either ambient temperature, or the high temperature thermal equilibrium point for the solenoid. The present heat accumulation method is therefore substantially self-calibrating under normal operating conditions as solenoid temperature drops to ambient or reaches an upper thermal equilibrium condition.

The generated estimate of relative solenoid heat accumulation may then be applied for compensating relative solenoid drive power so as to normalize the mechanical outputs of the solenoids. The present invention describes a method of altering the solenoid force value to which each solenoid is driven in response to a calculated heat value. By way of example the electrical drive associated with a desired force value is modulated by a gain value computed in relation to the heat value and constants associated with the behavior of a solenoid within the system.

An object of the invention is to provide for the estimation of thermal heating within a solenoid in response to activations thereof.

Another object of the invention is to provide a mechanism for estimating relative solenoid temperature without utilizing a temperature sensor on each solenoid coil.

Another object of the invention is to provide solenoid drive compensation in response to the thermal heating of the solenoid such that solenoid drive fluctuation with respect to solenoid temperature may be normalized.

Another object of the invention is to provide solenoid drive temperature compensation wherein the amount of compensation is urged toward the average to reduce coil-to-coil variation thereof.

Another object of the invention is to provide a method of estimating coil temperature which may be utilized in a variety of electromechanical systems.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Figure 1:
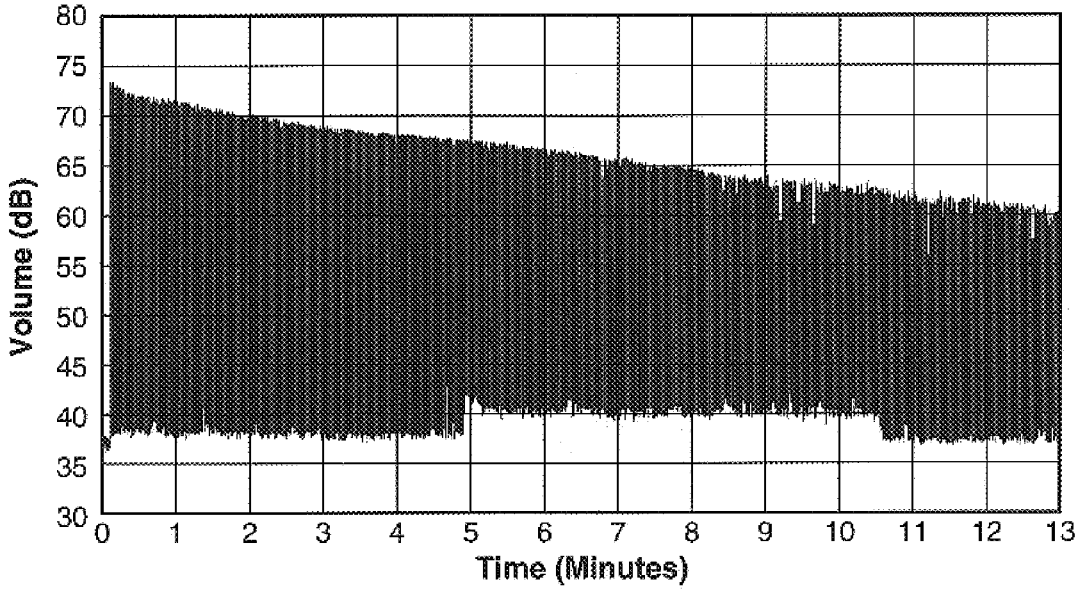
FIG. 1 (Prior Art)
FIG. 1 is a graph of audio volume for a conventional player piano key which is subjected to repeated activations over a period of time.
Figure 2:
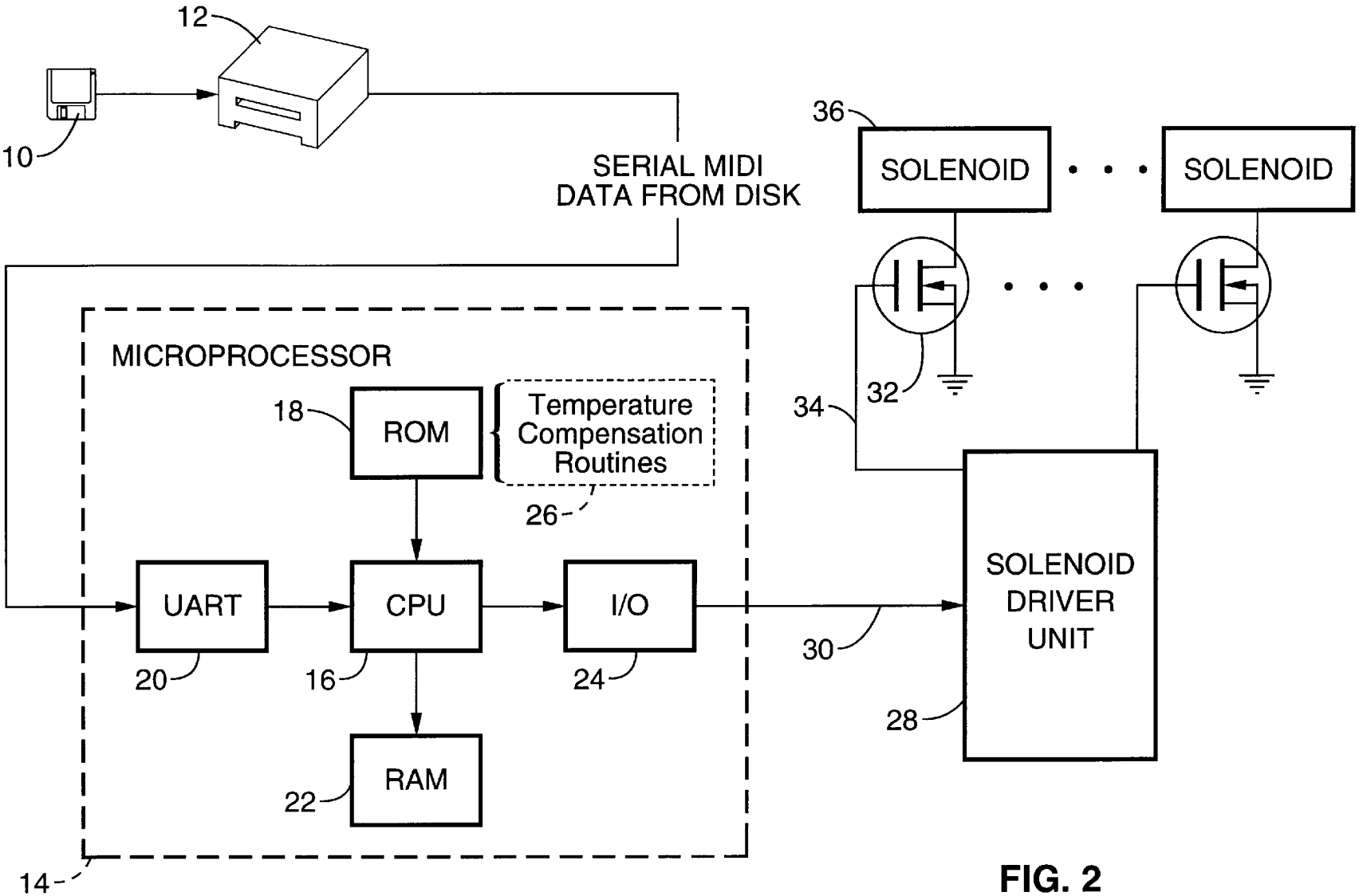
FIG. 2 is block diagram of a player piano solenoid drive in which temperature compensation according to an embodiment of the present invention may be practiced.
Figure 3:
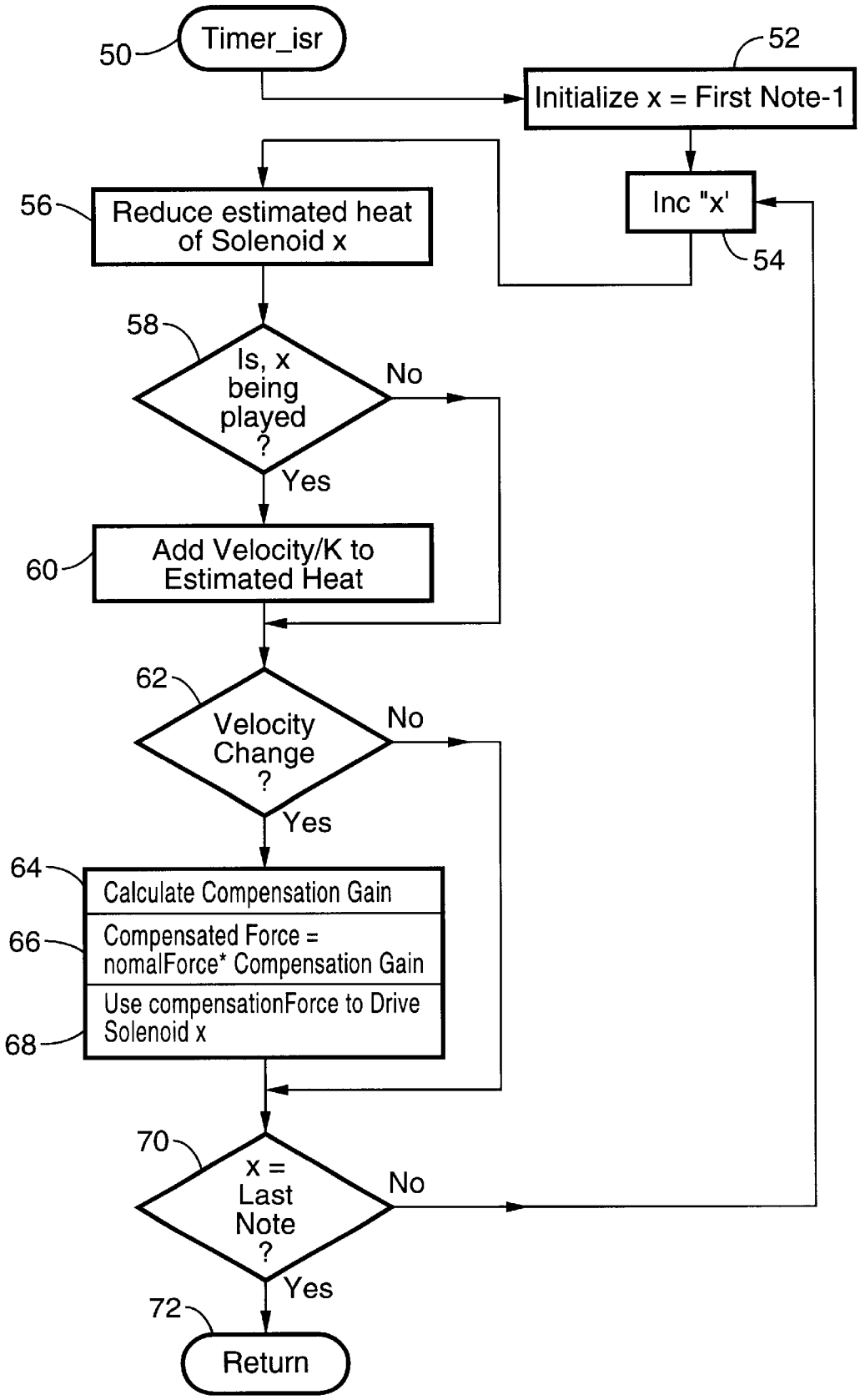
FIG. 3 is flowchart of a temperature compensation routine according to an aspect of the present invention shown calculating accumulated solenoid heat and performing temperature compensation of the drive signals to stabilize applied solenoid force.
Figure 4:
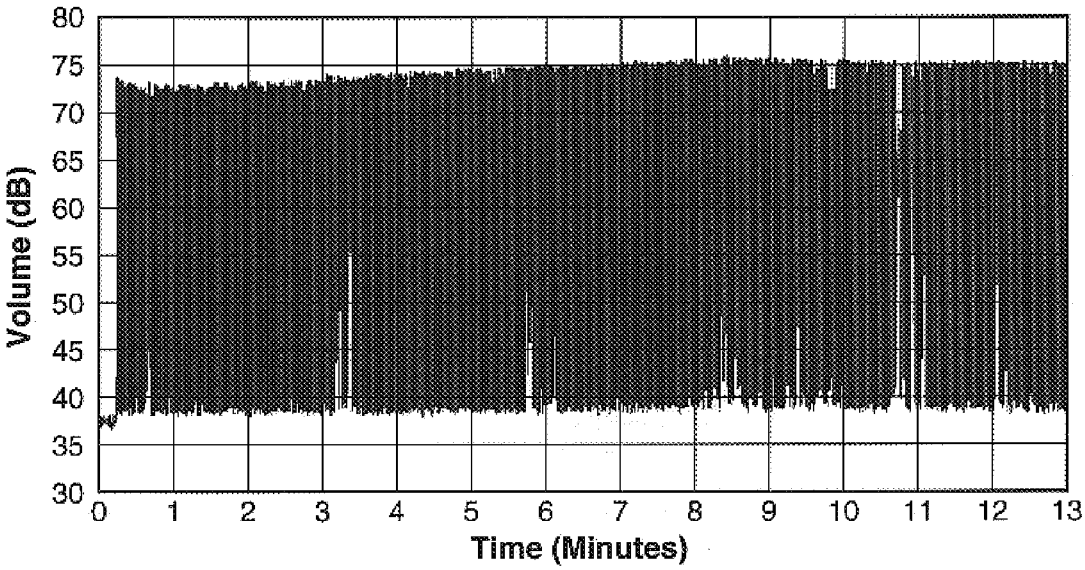
FIG. 4 is a graph of audio volume for a player piano key according to a temperature compensating aspect of the present invention shown subject to repeated activations over a period of time.

Referring more specifically to the drawings, for illustrative purposes the present invention is embodied in the apparatus generally shown in FIG. 2 through FIG. 4. It will be appreciated that the apparatus may vary as to configuration and as to details of the parts, and that the method may vary as to the specific steps and sequence, without departing from the basic concepts as disclosed herein.

FIG. 2 illustrates, by way of example, an embodiment of a player piano solenoid system which drives the solenoids in response to the combination of composition data and the execution of temperature compensation routines within a control device such as a microprocessor. The player piano system within the figure is shown by way of example, and not of limitation, to illustrate a control system within which the present invention may be practiced. A disk 10 containing musical composition data is shown configured for insertion in a reader 12 that communicates with a piano controller 14, which is preferably implemented as a microprocessor. It will be appreciated that a microprocessor is configured with a central processing unit (CPU) 16, a program store 18 which typically comprises read-only memory (ROM), universal asynchronous receiver-transmitter (UART) 20, random access memory (RAM) 22, and an output section 24. The method of the present invention is preferably embodied within routines 26 that are executed by piano controller 14, such as contained within the program store 18 for a microprocessor. Controller 14 is connected to a solenoid driver unit 28, also referred to herein as "driver", by a driver communication line 30. Driver 28 is capable of controlling the FET driver transistors 32, through signal line 34, for activating a plurality of solenoids 36. In the depicted embodiment, each solenoid is associated with a particular key on the piano and subject to activation by the player-piano controller and driver circuits. It should, however, be appreciated that the present invention is applicable to a wide variety of devices and systems which require energizing one or more coils whose output is responsive to self-generated heat.

Within the present invention, heat is tracked for each solenoid as a relative heat value contained in an array of heat values. Generally each solenoid gains heat when its coil is activated and continues to do so until coil current is discontinued or until maximum gain is reached. This is represented by the following array formula:

$$Heat[coil]=heat[coil]+force \quad (1)$$

wherein Heat[coil] comprises an array which holds the value of accumulated heat for each solenoid being tracked. Within a conventional player piano the array would preferably contain eighty eight array elements corresponding to each key on the keyboard. The value for "force" is preferably configured as a percentage of full power as sent to the coil of the solenoid. It is also preferable that the calculation be performed on a periodic basis, such as every five milliseconds (5 mS), so as to maintain a valid ongoing estimate for the solenoid heat value. The amount of heat contained in each solenoid is subject to thermal dissipation as the coil radiates heat to its surrounding. It will be readily appreciated that a solenoid which has reached an elevated temperature during operation will cool toward the ambient temperature during periods of relative inactivity. The amount of heat loss by the solenoid per unit of time is determined by the difference in temperature between the solenoid and the ambient temperature in response to a heat dissipation constant. It will be appreciated, therefore, that increases in solenoid temperature result in associated higher levels of thermal heat dissipation. The heat accumulated in the solenoid may be periodically updated in response to heat loss according to the following calculation:

$$Heat[coil]=heat[coil]-heat[coil]/heatConstant \quad (2)$$

As the thermal mass of the coil prevents rapid temperature change, the drop in temperature is preferably calculated at longer intervals than that used for monitoring the activity states of the coils. For example in the present embodiment, the heat loss is calculated every four hundred forty milliseconds (440 mS), which is sufficient to maintain proper heat value estimates. The value for heatConstant may be found empirically so that the return of the heat value to zero approximately coincides with that of the actual coil returning to ambient temperature. A calculation for "gain" should result in a gain of one at ambient temperature and the desired maximum gain at the state of thermal equilibrium.

$$gain=(gainConst+heat[coil]/CONST1+heat[coil+1]/CONST2)/gainConst \quad (3)$$

$$IF(gain>MAXGAIN) \text{ then } gain=MAXGAIN \quad (4)$$

The value for MAXGAIN signifies the amount of gain necessary to compensate for heat losses at thermal equilibrium, and may be determined empirically for a given system. To minimize the effects of errors, two heat values, "coil" and "coil+1" are incorporated within the gain calculation to urge the resultant gain values back toward an average value for the keys. It will be appreciated that the heat values for "coil" and "coil+1" are subject to different weighting constants to control their relative contributions to the gain calculation. By way of example, CONST1 was set to six thousand one hundred forty four (6144) and CONST2 was set to twelve thousand two hundred and eighty eight (12288) within a particular embodiment, wherein the averaging effect from an adjacent solenoid is limited to about thirty percent of the overall response. Averaging-in contributions from adjacent solenoids can also reduce errors when heat transfer occurs between adjacent solenoids. The gain value can be utilized as a coil power multiplier such that solenoid at elevated temperatures are energized with a coil drive signal that compensates for the estimated relative temperature of the solenoid's coil. The gain value in the present embodiment increases from unity for solenoids at ambient temperature, up to a value of maximum gain which exceeds unity. The power with which the solenoid would normally have been driven is thereby multiplied by the gain factor so that solenoid operation may continue without temperature induced audio volume fluctuations. It should be appreciated that the constants and average weighting of the heat quantities may be performed utilizing any of a number of values or weighting factors associated with the target system without departing from the present invention.

Often significant errors can arise in applications that rely on a series of estimations, and these errors can be incurred both as a result of first order errors and cumulative errors. Within the present invention, however, the estimation method is subject to limited error accumulation since the accumulation of heat within each solenoid is bounded by the ambient temperature at the low temperature end of operation, and by the temperature corresponding to a state of thermal equilibrium at the upper end of the temperature range. As represented by Eq. 4 above for the present model, no heat is added to the heat value once the heat associated with MAXGAIN has been achieved. It will be appreciated that when a coil reaches a state of thermal equilibrium the maximum heat compensation gain is equivalent to the power loss. Temperature estimates therefore are bounded by the ambient temperature state and the state of high temperature thermal equilibrium, wherein the cumulative error is automatically nulled as the solenoid becomes subject to either boundary condition. The present model is therefore generally self-calibrating and not subject to accumulated errors that plague many estimation techniques.

An averaging function is preferably incorporated within the heat accumulation estimation routines so that solenoids whose compensation is far from the average level of heat are pulled towards the average. An example of averaging is shown in Eq. 3 wherein an adjacent coil "[coil+1]" is included in the calculation at a lower gain level to urge the overall gain values toward an average.

FIG. 3 illustrates steps according to an embodiment of the present inventive method for estimating the accumulated heat within a solenoid and providing temperature compensation for the solenoid coil drive value. It will be appreciated that the steps of the flowchart are to be preferably implemented for execution within a player piano controller mechanism, such as microcontroller 14. The heat and compensation calculations are preferably periodically performed within an interrupt service routine (isr), such as a Timer_isr, a portion of which commences at block 50. It should be appreciated that the temperature compensation routine should preferably be performed for each solenoid coil within the instrument. It should also be appreciated that the compensation calculations may be implemented using a number of alternative forms without departing from the present invention. After Timer_isr entry initializations are performed, a pointer "X" is set to one note prior to the first note in the sequence at block 52. The value of "X" is incremented to point to the first note in the sequence at block 54. The heat dissipation of the solenoid is taken into account at block 56 by reducing the heat value of solenoid "X" by a predetermined percentage. If coil "X" is energized, as detected in block 58, then the velocity divided by a constant is added to the heat value at block 60. If the velocity of solenoid "X" is to be changed, as detected at block 62, then a compensating gain is calculated at block 64. The desired solenoid force is multiplied by the compensation gain to adjust for the effects of increased temperature on the coil at block 66. The compensated solenoid values are then used to drive the coil of the solenoid at block 68. If note "X" is equal to the last note for which compensation is to be performed as detected in block 70, then the interrupt service routine exits, otherwise the routine loops back and is executed for each of the remaining notes.

Accordingly, it will be seen that this invention provides a method of estimating accumulated heat within a solenoid, such as within the described player piano application, and further provides a method of compensating the drive signals to a given coil in accord with the estimated temperature. It will be appreciated that the method does not require that the coils each contain a temperature sensor, nor does the technique require that the ambient temperature be known for the given device containing the multiple coils. It should further be appreciated that the method of the present invention is applicable to coils for use in solenoids and coils in general use such as contained in alternative forms of periodically driven systems subject to coil heating. The inventive embodiment describes, according to a series of steps, a temperature estimation and compensation method, however, it will be appreciated that the method of the invention may be implemented in a variety of ways without departing from the teachings of the present invention.

Although the description above contains many specificities, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A method of estimating accumulated heat for a device subject to coil heating during activations thereof, comprising:

initializing a heat quantity value for said device at ambient conditions;

periodically adding a quantity of heat to the heat quantity value if the associated device coil is active;

periodically reducing the heat quantity value toward ambient by an amount in response to said heat quantity value as subject to a heat dissipation factor;

determining a temperature compensating gain value based on said accumulated heat value for said device as modified by a gain constant;

wherein said gain value is applied to the drive signal being output for each device to compensate device operation based on temperature changes; and wherein said gain value is weighted with other devices toward an average value.

2. A method as recited in claim 1:

wherein reducing the heat quantity value comprises reducing the quantity of heat by a fractional portion of said heat value.

3. A method as recited in claim 2:

wherein the fractional portion is determined in response to a heat dissipation factor for the device.

4. A method as recited in claim:

wherein the heat quantity is reduced according to the equation: Heat[coil]=heat[coil]−heat[coil]/heatConstant; and wherein heat[coil] is an array of heat quantity values for each coil within the array and the heatConstant is determined according to the heat dissipation for a given coil.

5. A method as recited in claim 1:

wherein the process of adding a quantity of heat is performed according to the equation: Heat[coil]=heat[coil]+force;

wherein heat[coil] is an array of heat quantity values for each coil within the array; and wherein force is a value corresponding to the amount of energy supplied to the coil of said device.

6. A method as recited in claim 1, wherein determining said gain value comprises:

adding a gain constant to weighted heat values for a device and one or more additional associated devices to arrive at an average weighted heat value; and dividing the average weighted heat value by said gain constant to arrive at said gain value.

7. A method as recited in claim 1:

wherein the process of determining the gain value is performed according to the equation: gain=(gainConst+heat[coil]/CONST1+heat[coil+1]/CONST2)/gainConst;

wherein said gain value may be used to temperature compensate the drive signals to said device, gainConst is associated with the drive circuit of the system;

wherein said gain is averaged over at least two coils each having a separate weighting constant CONST1, CONST2.

8. A method as recited in claim 7:

wherein the gain calculation is limited to a maximum gain value associated with a thermal equilibrium value for said device.

9. A method as recited in claim 7:

wherein the device subject to coil heating is a solenoid.

10. A method as recited in claim 9:

wherein the solenoid is adapted for use within the player mechanism of a piano as controlled by a player system.

11. In an electronic player-piano system having an electronic controller to control the force with which keys are activated by a solenoid driver in response to music composition data, the improvement comprising:

a temperature compensation routine executable by said electronic controller;

wherein said temperature compensation routine maintains a heat value for each solenoid being driven;

wherein said heat value is periodically increased in response to activation forces applied to the solenoid of each key;

wherein said heat value is periodically decreased by an amount in response to the thermal heat dissipation of each solenoid;

wherein the thermal dissipation value to be subtracted from said heat value is determined by dividing said heat value by a heat dissipation factor;

wherein said routine calculates a gain value for each solenoid based on said heat value; and wherein said gain value utilized within the routine modulates the outputs for driving said solenoids to prevent thermally induced force roll-off within the solenoids.

12. An improvement as recited in claim 11:

wherein said heat value is periodically increased in response to the percentage of full power which is applied to said solenoid.

13. An improvement as recited in claim 11:

wherein said heat value is periodically decreased by an amount which is calculated from said heat value as divided by a heat constant.

14. An improvement as recited in claim 11:

wherein said gain value is calculated from the equation $$gain=(gainConst+heat[coil]/CONST1+heat[coil+1]/CONST2)/gainConst;$$

wherein said gain value may be multiplied times the power value to be applied to said solenoid of said device, and gainConst is associated with the drive circuit of the system; and wherein said gain is averaged over at least two solenoid coils each having a separate weighting constant CONSTx.

15. An improvement as recited in claim 14:

wherein the gain value is limited to a maximum gain value associated with a thermal equilibrium state for said solenoid.

16. A method of temperature compensating the power being applied to a solenoid based on an estimate of the heat accumulated within said solenoid, comprising:

initializing a heat quantity value for said solenoid at ambient conditions;

reducing said heat quantity value by a given percentage;

accumulating heat within said heat quantity value by adding a quantity of heat in response to the power applied to said solenoid;

calculating a temperature compensation gain value based on said heat quantity value;

multiplying the power value to be applied to said solenoid by said temperature compensation gain value to prevent solenoid force roll-off as solenoid temperature increases; and periodically repeating the above steps following said initialization to maintain an updated value of temperature compensation.

17. A method as recited in claim 16:

wherein said reduction of said heat quantity value by a given percentage comprises subtracting a quantity from said heat value given by the accumulated heat value divided by a heat dissipation value.

18. A method as recited in claim 16:

wherein the temperature compensation is being performed for multiple solenoids.

19. A method as recited in claim 16:

wherein said temperature compensation gain value is based on said heat value of a given solenoid averaged with one or more additional solenoids.

20. A method of estimating accumulated heat for a device subject to coil heating during activations thereof, comprising:

initializing a heat quantity value for said device at ambient conditions;

periodically adding a quantity of heat to the heat quantity value if the associated device coil is active;

periodically reducing the heat quantity value toward ambient by an amount in response to said heat quantity value as subject to a heat dissipation factor, wherein the heat quantity is reduced according to the equation: Heat[coil]=heat[coil]−(heat[coil]/heatConstant); and wherein heat[coil] is an array of heat quantity values for each coil within the array and the heatCostant is determined according to the heat dissipation for a given coil.

21. A method as recited in claim 20: wherein the process of adding a quantity of heat is performed according to the equation: Heat[coil]=heat[coil] fame;

wherein heat[coil] is an array of heat quantity values for each coil within the array; and wherein force is a value corresponding to the amount of energy supplied to the coil of said device.

22. A method as recited in claim 20, further comprising:

determining a temperature compensating gain value based on said accumulated heat value for said device as modified by a gain constant;

wherein said gain value may be applied to the drive signal being output for each device to compensate device operation based on temperature changes.

23. A method as recited in claim 22:

wherein said gain value is weighted with other devices toward an average value.

24. A method as recited in claim 22, wherein determining said gain value comprises:

adding a gain constant to weighted heat values for a device and one or more additional associated devices to arrive at an average weighted heat value; and dividing the average weighted heat value by said gain constant to arrive at said gain value.

25. A method as recited in claim 22:

wherein the process of determining the gain value is performed according to the equation: gain =(gain Const+heat[coil]/CONST1+heat[coil]/CONST2)/gainConst wherein said gain value may be used to temperature compensate the drive signals to said device, gainConst is associated with the drive circuit of the system;

wherein said gain is averaged over at least two coils each having a separate weighting constant CONST1, CONST2.

26. A method as recited in claim 25:

wherein the gain calculation is limited to a maximum gain value associated with a thermal equilibrium value for said device.

* * * * *

UNITED STATES PATENT AND TRADEMARK OFFICE

CERTIFICATE OF CORRECTION

PATENT NO. : 6,687,636 B2
DATED : February 3, 2004
INVENTOR(S) : Mark A. Van Sant It is certified that error appears in the above-identified patent and that said Letters Patent is hereby corrected as shown below:

Column 2,
Line 52 change “sensor” to -- sensors --

Column 6,
Line 55, change “solenoid” to -- solenoids --

Column 9,
Line 1, insert -- 1 -- after “claim”
Line 40, change “7” to -- 1 --

Column 11,
Line 7, change “fame” to -- +force --

Column 12,
Line 9, change “coil” to -- coil+1 -- (second occurrence)

Signed and Sealed this

Twenty-first Day of June, 2005

JON W. DUDAS
*Director of the United States Patent and Trademark Office*